United States Patent [19]

Carter et al.

[11] Patent Number: 4,581,097

[45] Date of Patent: Apr. 8, 1986

[54] LABELING APPARATUS

[75] Inventors: Sidney T. Carter, Shrewsbury; John W. Watkins, Worcester, both of Mass.

[73] Assignee: Figgie International, Inc., Willoughby, Ohio

[21] Appl. No.: 614,335

[22] Filed: May 25, 1984

[51] Int. Cl.[4] ..... B65C 3/18; B65C 9/02

[52] U.S. Cl. ..... 156/560; 156/568; 156/571; 156/DIG. 14; 156/DIG. 25; 156/DIG. 28

[58] Field of Search ..... 156/560, 568, 571, DIG. 14, 156/DIG. 25, DIG. 38, DIG. 28

[56] References Cited

U.S. PATENT DOCUMENTS

| | | | |
|---|---|---|---|
| 3,723,228 | 3/1973 | Schaltegger | 156/571 |
| 4,090,913 | 5/1978 | Zodrow | 156/560 |
| 4,146,421 | 3/1979 | Zodrow | 156/560 |

*Primary Examiner*—Michael Wityshyn
*Attorney, Agent, or Firm*—Robert T. Gammons

[57] ABSTRACT

Labeling apparatus for applying labels to bottles at different levels to areas of different radius of curvature at the two different levels, for example, the body and neck of a bottle, comprising applicators supported for movement in unison about a common axis relative to a conveyor on which are bottles to which labels are to be applied for movement along a predetermined rectilinear path at a predetermined speed wherein one of the applicators is supported at a fixed radial distance from the common axis of rotation of the applicators about said common axis such that at its place of engagement with the body of the bottle, it moves at a speed corresponding to the speed of the bottle, wherein the other is supported for radial movement relative to the common axis of rotation of the applicators for rotation about said common axis at a radial distance from the common axis to have engagement with the neck of the bottle, wherein the latter applicator is rotatable relative to the common axis of rotation of the applicators as it is rotated about said common axis in a direction opposite to its direction of rotation about said common axis and wherein there is an arm mounted to the latter applicator movable into engagement with the trailing side of the neck of the bottle as the latter applicator is moved into engagement with the neck of the bottle to constrain movement of said latter applicator as it is moved into engagement with the neck of the bottle to the speed of movement of the bottle.

5 Claims, 17 Drawing Figures

LABELING APPARATUS

BACKGROUND OF THE INVENTION

Labeling apparatus is required to apply labels to bottles at different levels and to areas at different radial distances from the vertical axis of the bottle, for example, the body of the bottle which is of one radius of curvature and the neck and/or shoulder of the bottle which is of smaller radius of curvature. If the labeling apparatus is of the kind wherein the label applicators are rotated about a common axis adjacent a rectilinearly-moving conveyor, the applicators at different radial distances from the center of rotation travel at different speeds, hence, at the place of engagement with the bottle, the labels will be displaced relative to each other. This displacement is not acceptable and, hence, some labeling apparatus has been provided with two or more label-applying stations so that at each station, the label applicator can be driven independently of that at any other station to insure moving it at the speed of the conveyor and to thus properly apply the label. Such practice is not wholly desirable because it increases the length of the machine and duplicates much of the driving structure. Other labelers, for example, such as shown in U.S. Pat. Nos. 4,090,913 and 4,118,269 have mounted the applicators at a common station for applying labels simultaneously to the areas at different radial distances from the vertical axis of the bottles; however, the kinematics for compensating for the difference in speed of the applicators due to their different radial distances from the center of rotation are complicated and expensive to manufacture and maintain. It is the purpose of this invention to provide an improved labeling apparatus wherein labels can be applied to a bottle at a common station simultaneously to portions of areas at different radial distances from the vertical axis of the bottle and symmetrically with respect to each other. The labeling apparatus as herein described is operable to apply labels to bottles of both circular and non-circular cross section.

SUMMARY OF THE INVENTION

As herein illustrated, the labeling apparatus of this invention comprises conveyor means for moving bottles along a predetermined rectilinear path in spaced relation and means for applying labels to the bottles traveling along on the conveyor means at different levels heightwise thereof and to areas of different radius of curvature at said different levels comprising vertically-spaced applicators supported for simultaneous application of labels to the areas of different radius of curvature at said different levels, means for rotating the supported applicators in unison about a common axis at a rate such that, at the place of engagement of one of said applicators with an area of one radius of curvature, the linear speed of the conveyor means and the rotational speed of said one applicator are the same, such that said one applicator will apply a label to the bottle at the place of engagement therewith symmetrically with respect to the vertical axis of the bottle, means for moving the other applicator radially with respect to the axis of rotation to a position to have engagement with an area of different radius of curvature and means for modifying the speed of movement of said latter applicator to compensate for the difference in speed of said latter applicator and the conveyor to cause said latter applicator to apply a label to the bottle symmetrically with respect to the vertical axis of the bottle and to the label applied to said area of one radius of curvature. The first-mentioned applicator is desirably fixed to a rotating support at a fixed radial distance from the axis of rotation thereof for rolling engagement with the surface of the body of the bottle at the place of engagement therewith. The second-mentioned applicator is supported for radial movement on the rotating support relative to the axis of rotation of the rotating support for engagement with the surface of the neck of the bottle and for rotation relative to the rotating support at its place of engagement with the neck of the bottle such as to apply a label to the neck of the bottle symmetrically with respect to the axis of the bottle and the label applied to the body of the bottle. The rotating supports are fixed to a common shaft for rotation in unison about a predetermined common axis adjacent the conveyor means, one above the other. The applicator for applying labels to the body of the bottle is fixed to said one of the supports at a predetermined radial distance from the axis of rotation such as to have rolling engagement with a bottle traveling along on the conveyor means and the applicator for applying labels to the neck of the bottle is mounted to the other of the supports for radial movement relative to the axis of rotation into engagement with the neck of the bottle and for rotational movement relative to the axis of rotation about a center spaced from the axis of rotation of the supports. There is spring means yieldably biasing the latter applicator in the direction of rotation of the supports and means for limiting the rotation of said latter applicator relative to the supports. Specifically, the latter support contains a radially-disposed slot and the latter applicator is provided with means engaged within the slot for guiding it radially in the slot. At the distal end of the slot is a lateral enlargement for permitting lateral pivotal movement within the slot about an axis spaced from and parallel to the axis of the supports. The spring means yieldably holds the applicator engaged with the leading side of the slot in the direction of rotation of the support. There is cam means operable by rotation relative to said latter support to move the latter applicator radially within the slot. Each support mounts periphally thereof a plurality of applicators. There is means for supplying glue-coated labels to the applicators, means associated with the applicators for removing the glue-coated labels from the label supplying means, means for holding the glue-coated labels after removal to the applicators as they travel from the supply means to a position of engagement with the bottle, means for releasing the labels from the applicators at the place of engagement with the bottle and means for separating the labels from the applicator at the place of engagement with the bottle. The means for holding the labels to the applicators during movement toward the place of engagement with the bottle comprises vacuum means and the means for separating the labels from the applicator at the place of engagement with the bottle comprises air jets.

The invention will now be described with reference to the accompanying drawings, wherein.

Figure 1:
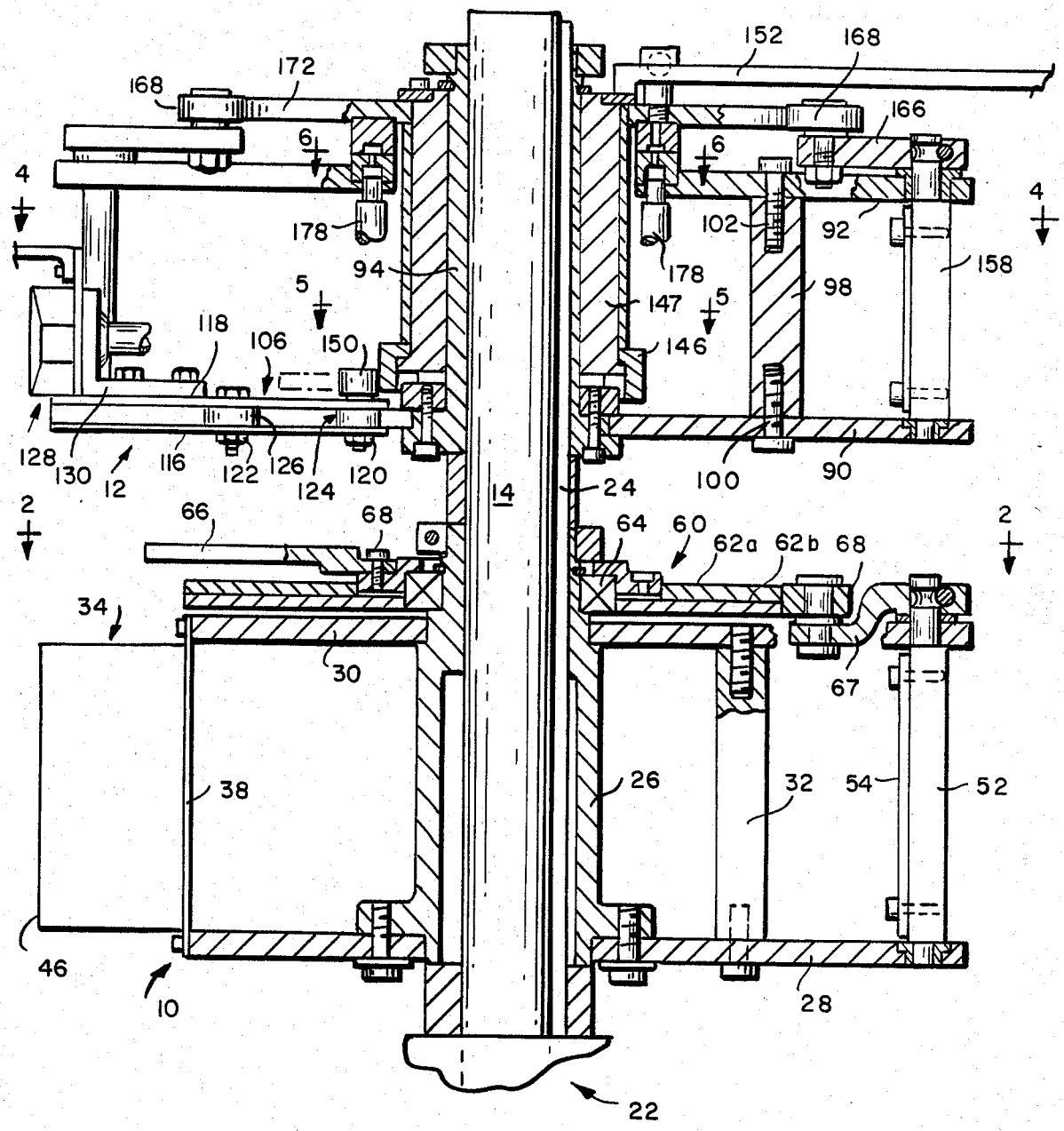
FIG. 1 is a vertical diametral section of label-applying assemblies for applying labels to the body and neck of bottles.

Referring to the drawings, FIG. 1, there are shown in section an applicator turret assembly 10 for applying labels to the body of a bottle and an applicator turret assembly 12 for applying labels to the neck of a bottle. The applicator turret assemblies 10 and 12 are mounted in a common, vertically positioned shaft 14 for rotation about the vertical axis of the shaft relative to an assembly 16, FIG. 2, which provides for supplying glue-coated labels to the applicators and conveyor means 20 upon which the bottles B to which the labels are to be applied are moved along a rectilinear path in unifomly-spaced relation to each other.

Figure 2:
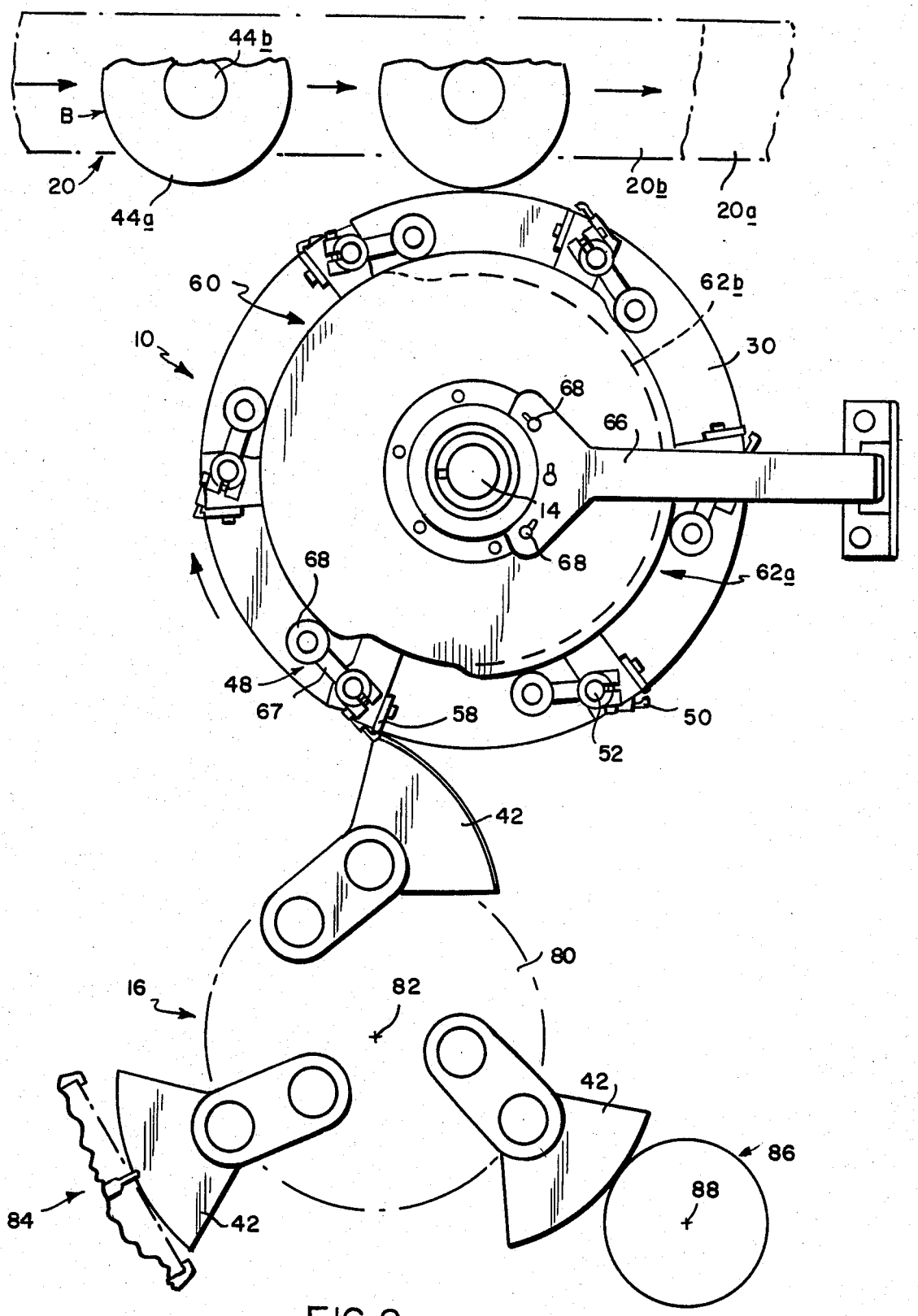
FIG. 2 is a plan view of the applicator assembly for applying labels to the bodies of bottles shown positioned between means for supplying labels thereto and bottle conveyor means.

The conveyor means, FIG. 2, is of conventional construction comprising a lower conveyor belt **20*a* on which the bottles rest and an upper conveyor belt 20*b* which has contact with the caps at the tops of the bottles for holding them upright. The conveyor belts 20*a* and 20*b*** are driven at the same linear speed.

The shaft 14 upon which the turret assemblies 10 and 12 are mounted is rotatably supported at its lower end in a bearing 22 and the applicator turret assemblies 10 and 12 are fixed thereto by a key 24 so that they can rotate in unison with the rotation of the shaft 14.

The assembly 10 which is for applying labels to the body of a bottle is supported on a bearing sleeve 26 and comprises spaced, parallel support disks 28 and 30 mounted to the lower and upper ends of the bearing sleeve 26 which is fixed to the shaft 14 by the key 24. The disks 28 and 30 are secured to each other in spaced, parallel relation by posts 32 spaced about the bearing sleeve 26. A plurality of applicator members 34 are mounted in peripherally-spaced relation about the shaft 14 between the disks 28 and 30 on bracket plates 38 secured to the disks. Each applicator member 34 is comprised of a cushion-like material such as, for example, foam rubber, attached to the bracket plate 38 at a fixed radial distance from the axis of the shaft 14. As herein shown, there are six applicator members 34 spaced about the vertical axis of the shaft 14. Each applicator member is so dimensioned that its outer lateral face 46 which is convex will have rolling engagement with a picker member 42, FIG. 2, by means of which glue-coated labels are supplied to the applicator members, as will be described in greater detail hereinafter, and rolling engagement with the body portion **44*a* of the bottle B traveling along with the conveyor means 20**.

Figure 1C:
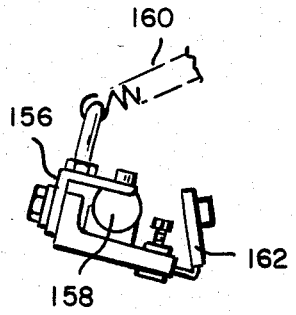
FIG. 1C is a top view of FIG. 1B.
Figure 1B:
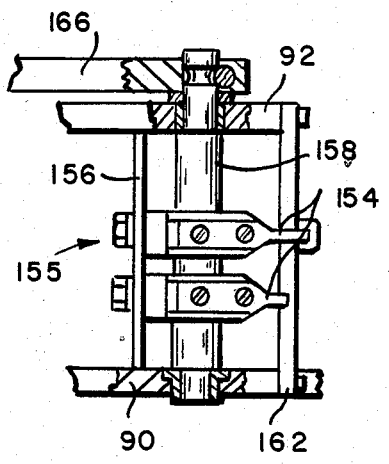
FIG. 1B is a fragmentary elevation of transfer fingers carried by the label-applying assembly for applying labels to the neck of a bottle.
Figure 1A:
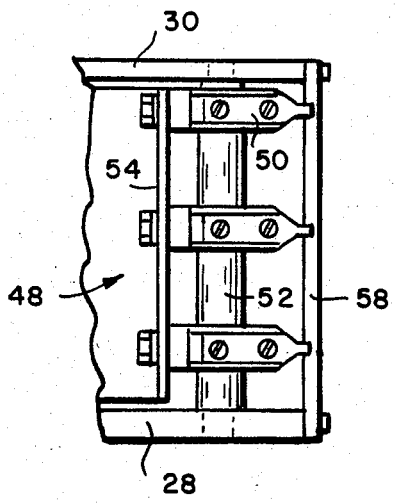
FIG. 1A is a fragmentary elevation of transfer fingers carried by the assembly for applying labels to the body of a bottle.

There are transfer means 48 on the turret 10, FIG. 2, corresponding in number to the number of applicator members 34 mounted peripherally of the plates 28 and 30 at the leading sides of the applicator members 34 with respect to the direction of rotation for transferring glue-covered labels from the picker members 42 and carrying them around to the place of application to the bottles traveling along on the conveyor and for there releasing the labels for transfer to the bottles. As herein illustrated, each of the transfer means 48 comprises three transfer fingers 50, FIG. 1A, mounted in vertically-spaced relation to a post 52 journaled at its upper and lower ends in the plates 28 and 30. The transfer fingers 50 are bolted to a common bracket member 54 and the latter is rotatably mounted on the post 52 and spring-biased by means of a spring, not shown, to yieldably press the transfer fingers into engagement with a bar 58 supported adjacent the leading side of the applicator members 34 to clamp the leading end of a label presented thereto by the label picker member 42 so that rotation of the applicator assembly 10 will remove a label from the picker member 42.

The transfer fingers 50 are moved into and out of engagement with the bar 58 by cam means which operates to move the fingers away from the bar to permit the leading edge of a label to be introduced between them and the bar, thereafter to clamp the label to cause it to be removed from the picker member 42 and, finally, to release the label at its place of application to the bottle to permit it to be transferred to the bottle. The cam means comprise cam plates **62*a*, 62*b*, FIGS. 1 and 2, rotatably supported by bearing means 64 on the bearing sleeve 26 and held in fixed relation to the shaft 14 by an arm 66 fastened at one end thereto by bolts 68 and at its other end to a fixed part of the machine. At the upper end of each post 52, there is fixed an arm 67 which supports a cam follower 68 and the latter is held in engagement with the peripheral edges of the cam plates 62*a*,62*b* by spring means, not shown, so as to follow the contour of the cam plates as the applicator assembly is rotated by the shaft 14. The cam plates 62*a*,62*b* are configured, FIG. 2, at their edges to move the transfer fingers 50 away from the bar 58 as they approach the picker means 42 to receive a label between the transfer fingers 50 and the bar 58, to close the transfer fingers 50 on the label as it passes the picker member 42 and again to move the transfer fingers 50 away from the bar 58** at the point of transfer of the label to the bottle to release it to the bottle.

As previously stated, the applicator assembly 10 is so dimensioned that the outer convex surface 46 of the applicator member 34 will have rolling engagement with the surface of the bottles to which the labels are to be applied and the shaft 14 is rotated at a speed with respect to the linear speed of the conveyor means 20 such that, at the point of rolling engagement, the speed of the applicator member 34 and the speed of the conveyor means 20 and, hence, the bottles B thereon are the same so that the label will be transferred to the body of the bottle without lateral slip, that is, symmetrically with respect to the vertical axis of the bottle. In accordance with conventional practice, following transfer of the labels to the bottles, the free ends of the labels are wrapped about the surface of the bottle by wipers, as shown in Pat. No. 4,115,179. As herein constructed, the radial distances of the convex surfaces of the applicators are somewhat greater than the distance between their axes of rotation and the surface of the bottles to which the labels are to be applied so as to apply pressure to the labels at their place of engagement with the surfaces of the bottles.

Referring now to the transfer members 42 by means of which glue-coated labels are supplied to the applicator members, there is shown in FIG. 2 a conventional structure which need not be described in detail herein except to point out that it comprises in general a rotary support 80 mounting three picker members 42 for rotation about a common axis 82 relative to the applicator assembly 10; a label holder 84; and a glue roll 86, to the surface of which glue is supplied. The label holder 84 is of conventional structure and supports a stack of labels with the foremost label in the holder in a position to have tangential engagement with picker members 42 as the latter are rotated relative thereto. The glue roll 86 is mounted for rotation about an axis 88 so positioned that it will have a tangential engagement with the surface of the picker members 42 as the latter travel around the axis 82 relative thereto. The aforesaid structure is old in the art and, hence, need not be described further herein.

The structure thus described provides for applying body labels to one side of bottles, but may be duplicated to apply labels to both sides of bottles traveling along on the conveyor means 20.

The conveyor means 20, FIG. 2, comprises an endless conveyor belt **20*a* mounted on suitable sprockets for movement of an upper run thereof in a horizontal plane and supports the bottles to which the labels are to be applied at their lower ends in an upright position and an endless conveyor belt 20*b* mounted on suitable sprockets for movement of a lower run above and in spaced, parallel relation to the upper run of the lower conveyor belt for engagement with the upper end of the bottles. The conveyor belts 20*a* and 20*b*** travel at the same speed and collectively support the bottles in fixed, upright positions as they travel past the applicator structure.

It is desirable not only to apply labels to the body **44*a* of the bottles, but also to the necks 44*b*. Due to the fact that the radial distance from the center of rotation of the applicators 34 and the necks of the bottles is greater than the distance from the center of rotation of the applicator to the body of the bottle, the applicators at the greater radial distance travel at a faster rate than the applicators at the lesser radial distance, hence, unless the difference in speed is accounted for, the labels will be displaced relative to the vertical axis of the bottle and to each other. In order to avoid this condition, it has been common practice to space the applicators for applying labels to different areas of the bottles along the conveyor and operate each at a speed corresponding to the movement of that portion of the bottle to which the label is to be applied. This practice was not wholly satisfactory since it extended the length of the apparatus and increased the number of mechanisms which had to be connected to the drive. Expedients have also been employed to apply the labels to the area at different radial distances from the vertical axis of the bottles at a common station; however, the complexity of the kinematics for carrying out this is expensive and difficult to maintain. In accordance with this invention, the applicator assembly 12 for applying the labels on the necks of bottles as referred to above is mounted to the same shaft 14 that the applicator assembly 10** is mounted for applying labels to the body and is rotated in unison therewith and so structured, as will now appear, as to enable applying labels to the necks of the bottles simultaneously with the application of the labels to the bodies of the bottles without lateral displacement to thus insure application of the labels to the necks and bodies of the bottles which are symmetrically located with respect to the vertical axis of the bottles and to each other.

Figure 8:
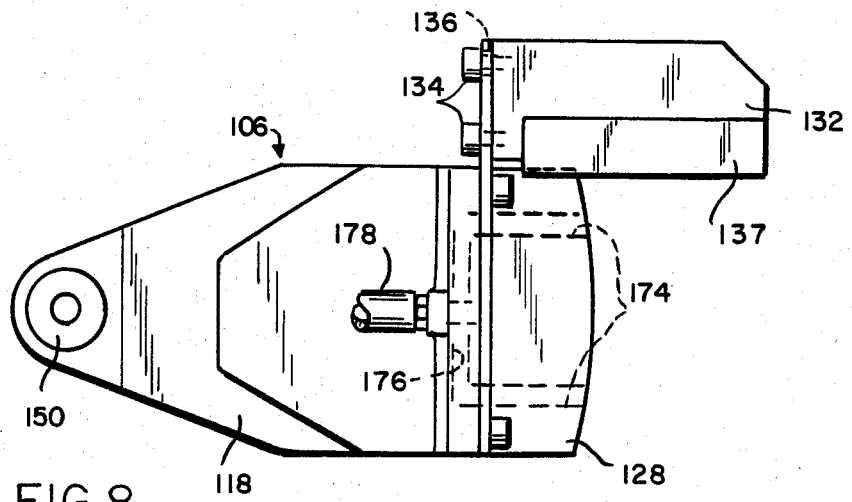
FIG. 8 is a view taken on the line 8—8 of FIG. 7.

As illustrated, FIG. 1, the turret assembly 12 comprises rigid circular support plates 90 and 92. The support plate 90 is clamped to a bearing sleeve 94 fixed to the shaft 14 for rotation therewith by the key 24 and is adjustable relative to the sleeve 94. The plate 92 is fixed to the plate 90 in spaced, parallel relation thereto so as to rotate therewith by peripherally-spaced posts 98, to the upper and lower ends of which the plates 90 and 92 are secured by bolts 100 and 102. The plate 90, FIG. 4, has a plurality of peripherally-spaced radial slots 104 within which are mounted corresponding numbers of applicator supports 106, FIGS. 1, 4 and 5, for radial movement therein and for pivotal movement relative to the plate 90. As illustrated, each radial slot 104 comprises a portion 108 which has spaced, parallel sides 110—110 and a portion 112 which has diverging sides 114—114. The applicator support 106, FIGS. 1 and 7, comprises a pair of spaced plates, a lower plate 116 and an upper plate 118 fixed in spaced, parallel relation to each other by bolts 120 and 122. A cam roll 124 is mounted on the bolt 120 between the plates and a cam roll 126 is mounted to the bolt 122 between the plates. These cam rolls or followers 124 and 126 are of a diameter to be received in the portions 108 and 112 of the slot 104. An applicator member 128 is secured to the outer end of the upper plate 118 of each applicator support 106 and comprises a yieldable block of material such as sponge rubber secured to a rigid bracket member 130 which, in turn, is fastened to the plate 118. The applicator support 106 is thus movable radially in the slot 104 to a position of engagement of the applicator member 128 with the neck of the bottle and, at this position, to be rotatable about the axis of the bolt 120 relative to the plate 90 by an amount corresponding to the distance between the diverging edges 114—114. At the trailing side of the support 106, FIG. 3, there is fixed to the bracket member 130 an arm 132, FIGS. 6 and 7, which projects outwardly from the outer face of the applicator member 128 substantially at right angles thereto. The arm 132 is mounted to the bracket 130 by means of bolts 134—134, FIG. 8, extending through slots 136—136 in the bracket to enable adjusting the arm 132 laterally for necks of different cross section. Desirably, a resilient bumper 137 is applied to the leading edge of the arm 130.

Figure 4:
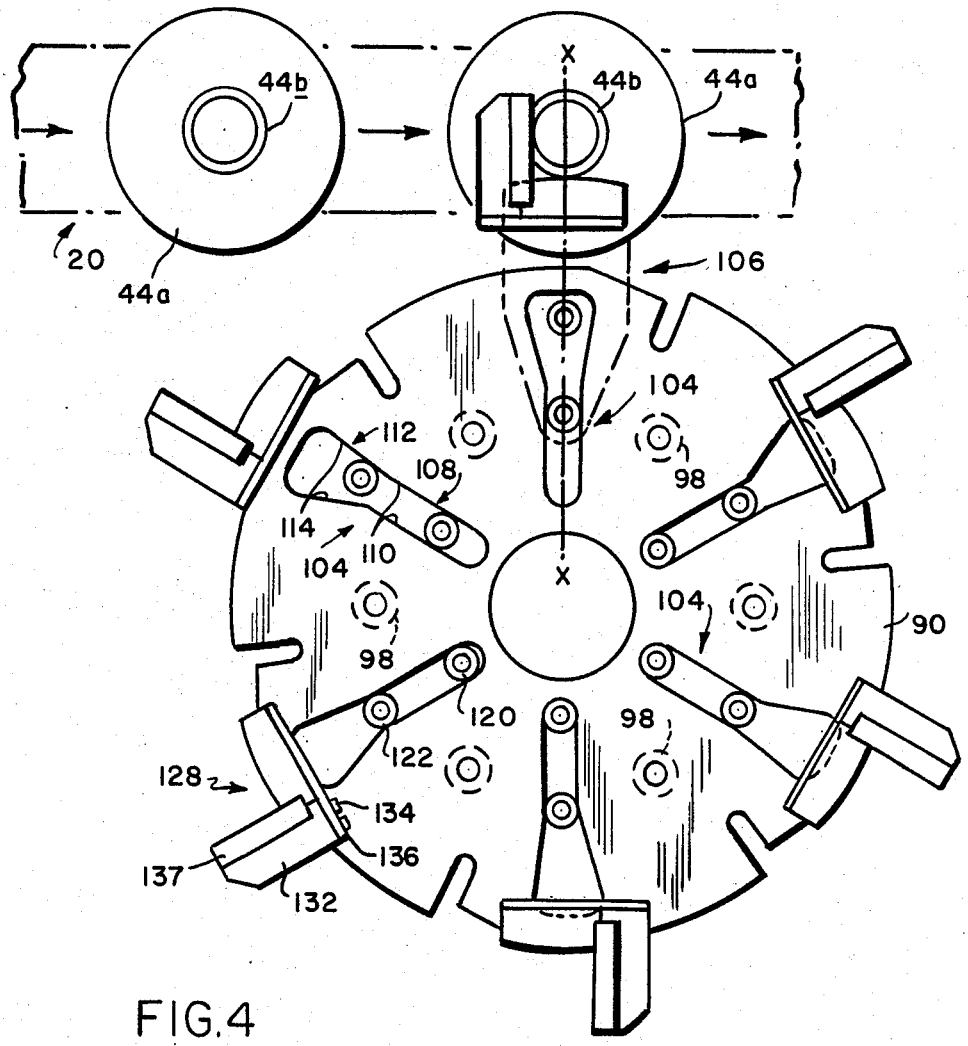
FIG. 4 is an elevation taken on the line 4—4 of FIG. 1.
Figure 5:
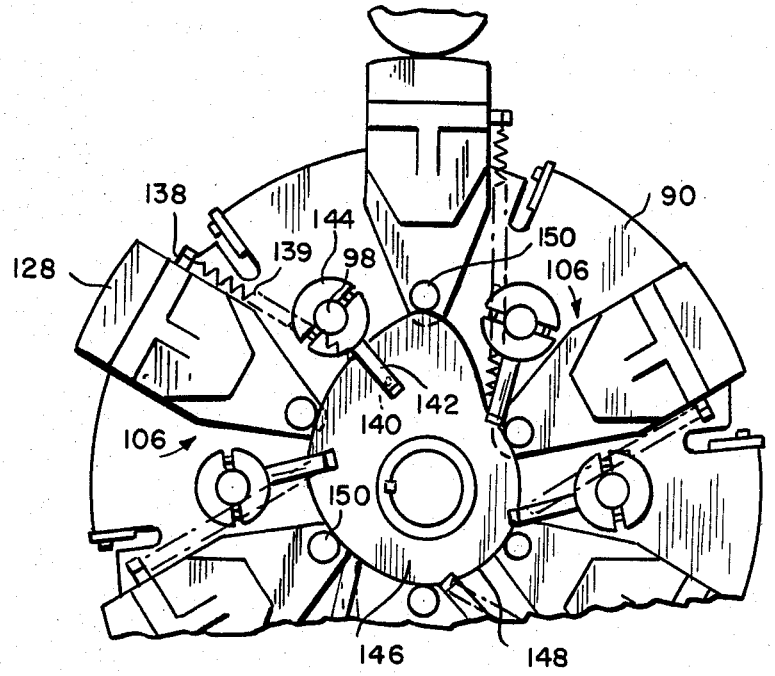
FIG. 5 is a fragmentary view taken on the line 5—5 of FIG. 1.
Figure 6:
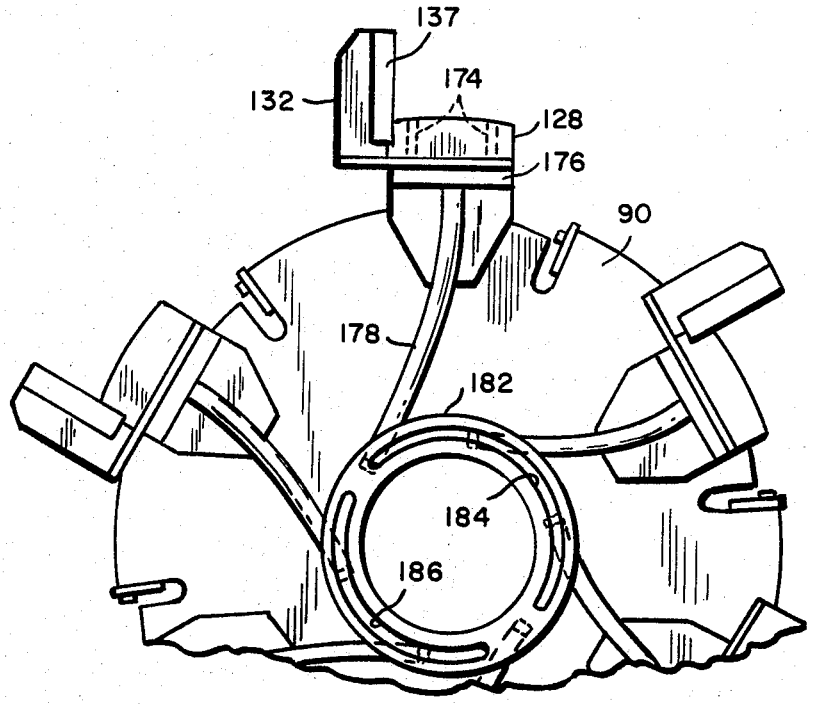
FIG. 6 is a fragmentary view taken on the line 6—6 of FIG. 1.

The applicator supports 106 are held retracted toward the center within the slots 108 by coiled springs 139, FIG. 5. One end of each spring 139 is attached at one end by a pin 138 to the bracket member 130 and the other end by a pin 140 fixed to one end of an arm 142, the other end of which is clamped by a clamp collar 144 to a post 98. The collar 144 is adjustable about the post 98 to displace the inner end of the spring 139 in a direction to bias the support 106 in a clockwise direction to thus yieldably hold the support unconstrained against the leading edges 110 and 112 of the slot 104. A cam plate 146, FIGS. 1 and 5, is fixed to the lower end of a bearing sleeve 147 mounted about the bearing sleeve 94 for rotation relative thereto and has a peripheral edge 148. A cam follower 150 is fixed to the upper end of each bolt 120 and these followers 150 are held engaged with the peripheral edge 148 of the cam plate 146 by the aforesaid springs 139. Rotation of the cam plate 146 will, accordingly, move the applicator support 106 radially. As illustrated, the configuration of the edge 148 of the cam is such as to move the applicator support radially outwardly, FIG. 5, as it approaches the conveyor means 20 to the end of the slot 104, FIG. 4, to a position of engagement of the applicator member 128 with the neck of the bottle and after the label has been applied to the neck of the bottle, to move it radially inward to retract it from the neck of the bottle and leave the label applied thereto. As shown in FIG. 5, the configuration of the cam plate 146 is such as to cause the applicator support to extend the applicator member 128 outwardly into engagement with the neck of the bottle and, following application, to retract it rapidly to minimize any tendency for the label to be displaced laterally relative to the vertical axis of the bottle. In its outwardly-extended position, the applicator support 106, as pointed out before, is pivotally movable about the axis of the bolt 120 relative to the plate 90 by reason of the enlargement of the slot 104 as defined by the diverging edges 114—114. The springs 139 yieldably hold the applicator supports engaged with the leading side of the slot in respect to the direction of rotation of the plate 90. The pivotal movement of the applicator support 106 in the extended position is brought about by the arm 132 which is moved into engagement with the trailing side of the neck **44*b* of the bottle just before engagement of the applicator member 128 with the neck of the bottle. Engagement of an arm 132 with the trailing side of the neck of the bottle moves the applicator member 128 when in its radially-extended position in a counterclockwise direction with respect to the direction of rotation of the plate 90 so that the applicator member 128 moves rearwardly with respect to the forward movement of the plate 90. The counterclockwise movement of the applicator support about the axis of the bolt 120 when the applicator support is in its radially-extended position relative to its clockwise movement about the axis of rotation of the plate 90 reduces the radial speed of the applicator member at its place of engagement with the neck of the bottle to that of the speed of the bottle. Thus, the application of the label to the neck will take place simultaneously with the application of the label to the body of the bottle and will be symmetrically applied with respect to the application of the label to the body of the bottle. As shown, the edges 114—114 diverge relative to the radial center line X—X of the slot 104 so that the spring 139 yieldably holds the applicator displaced ahead of the radial center line X—X of slot 104 in the direction of rotation against the edge 114. FIG. 4** shows the on-center position of the applicator at its fully extended position.

Figure 3:
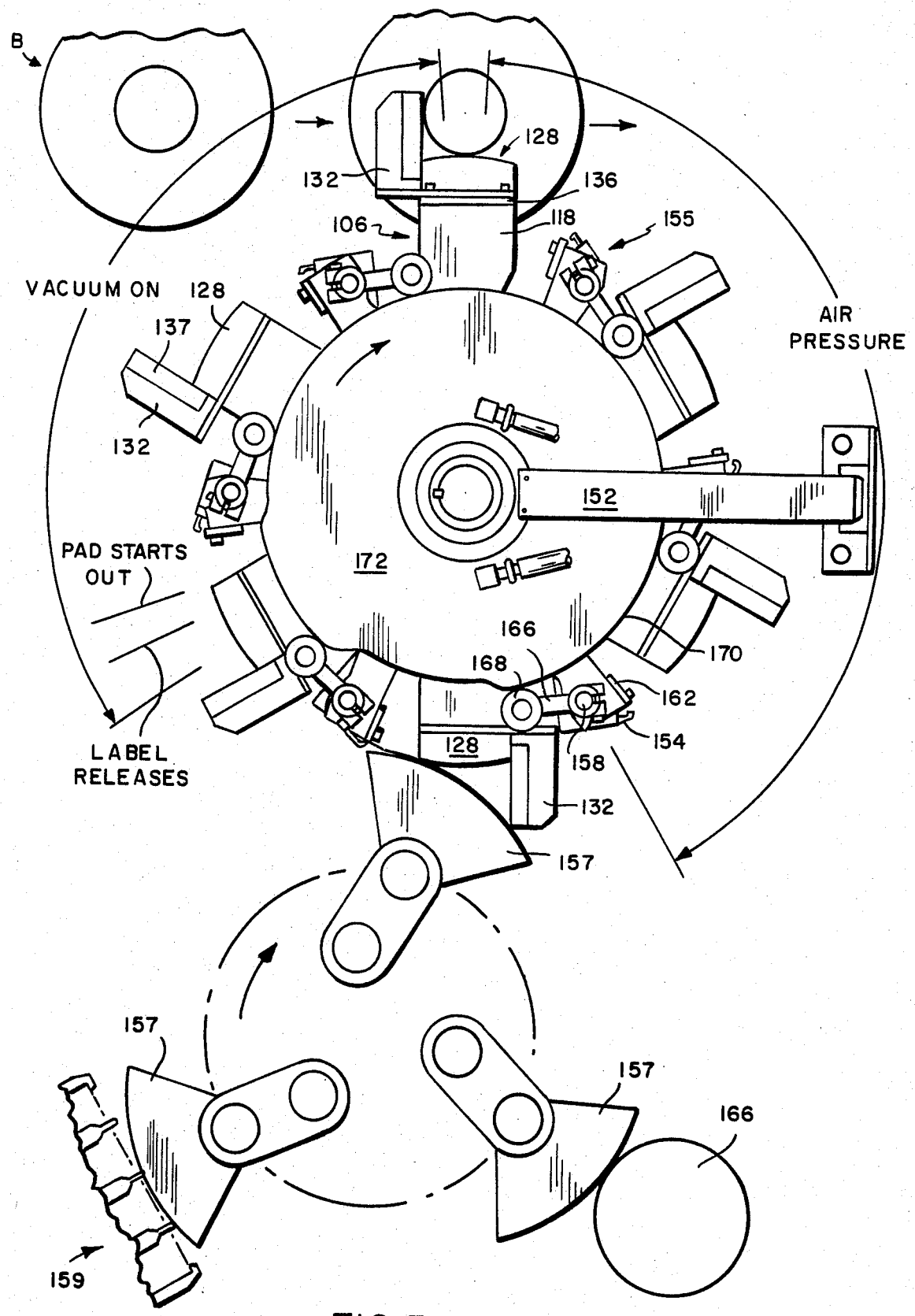
FIG. 3 is a plan view of the applicator assembly for applying labels to the necks of the bottles shown disposed between means for supplying labels thereto and the bottle conveyor means.
Figure 5A:
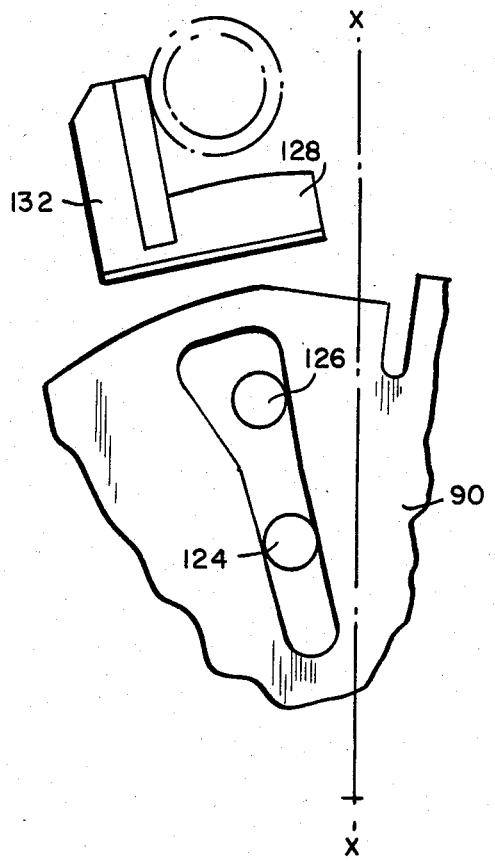
FIGS. 5A to 5E show successive positions of the applicator relative to the bottle as the applicator moves toward the bottle, into engagement with the bottle and away from the bottle.
Figure 5B:
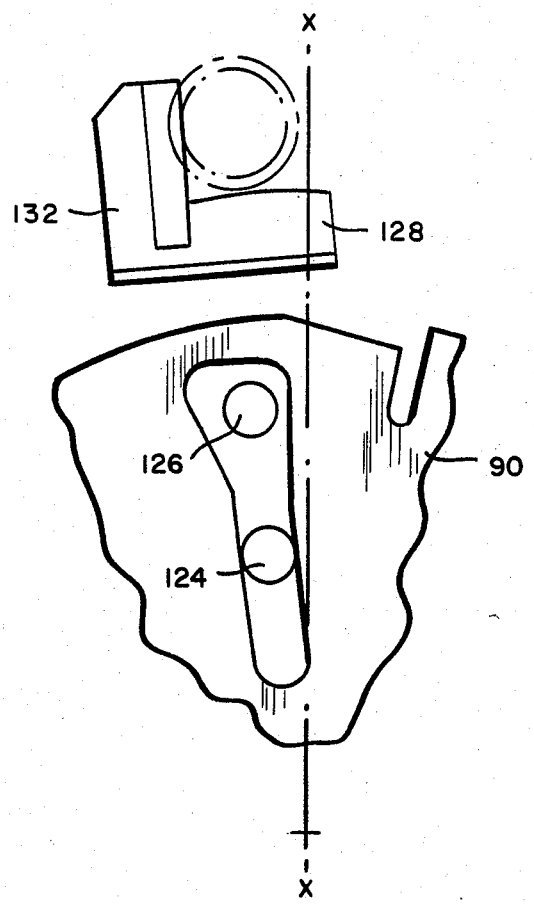
Figure 5C:
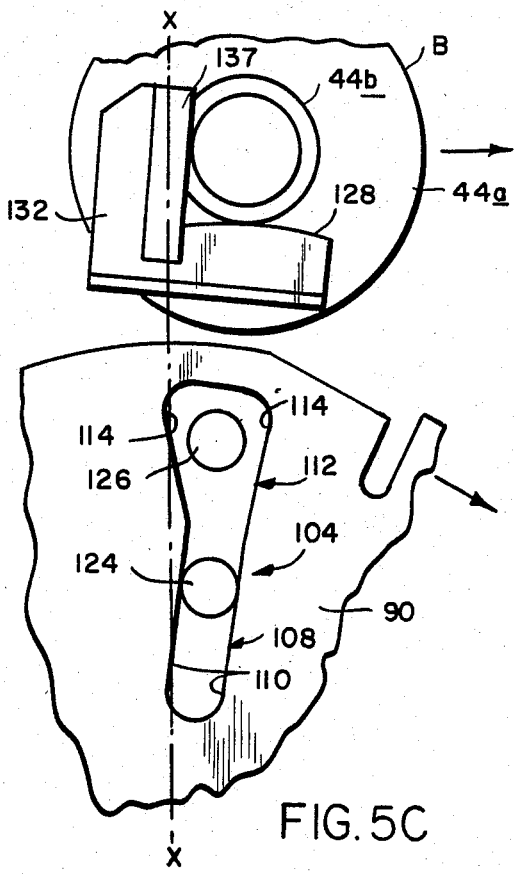
Figure 5D:
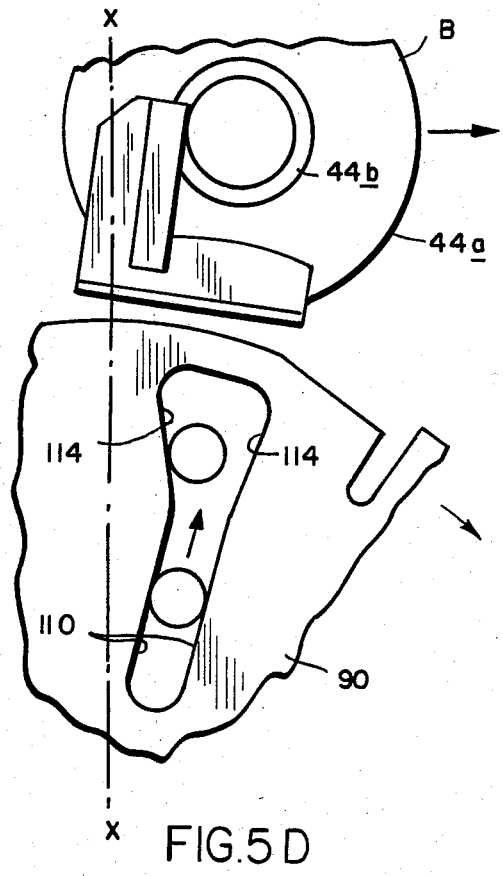
Figure 5E:
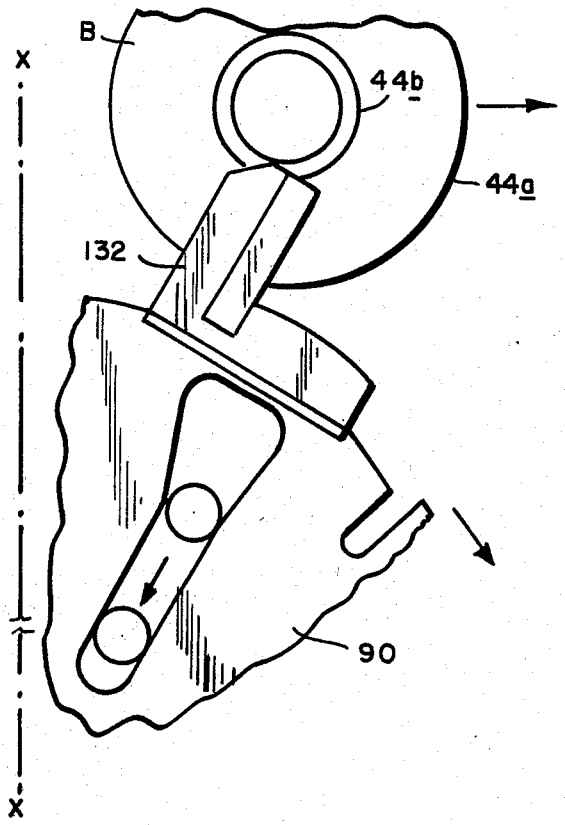

FIGS. 5A through 5E show successive positions of the applicator relative to the bottle as the applicator moves toward the bottle into engagement with the bottle and away from the bottle. Specifically FIG. 5A shows the position of the applicator relative to the bottle at $\frac{1}{4}$ pitch before the on center of position which is represented by the line X—X. FIG. 5B shows the position of the applicator relative to the bottle at $\frac{1}{8}$ pitch before the on center position. FIG. 3 shows the position of the applicator relative to the bottle at the on center position. FIG. 5C shows the position of the applicator relative to the bottle at $\frac{1}{8}$ pitch past the on center position. FIG. 5D shows the position of the applicator relative to the bottle at $\frac{1}{4}$ pitch past the on center position. FIG. 5E shows the position of the applicator at $\frac{1}{2}$ pitch past the on center position. It is important that the arm 132 touch the bottle just before the label does in order to correctly locate the label.

Figure 7:
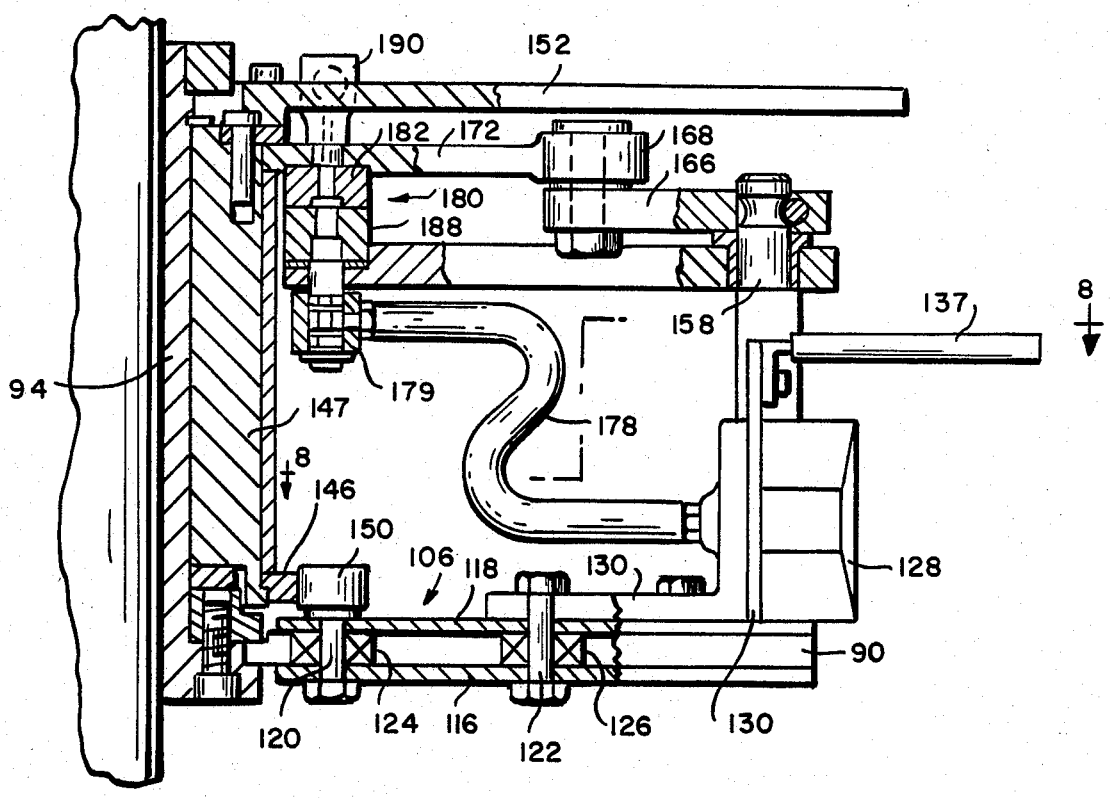
FIG. 7 is a fragmentary diametral section of the applicator assembly for applying labels to the neck of the bottle showing the applicator and means for supplying vacuum and air pressure thereto.

The cam plate 146, FIG. 5, is held stationary relative to the applicator support 106 by an arm 152, FIGS. 3 and 7, fixed at one end to the upper end of the bearing sleeve 147 and by attachment of its other end to a fixed part of the machine.

Adjacent each of the applicator members 128, there is transfer means 155, FIG. 3, for removing labels from label picker means 157 and releasing them to the neck of the bottle at the place of engagement of the applicator member 128 with the neck of the bottle. The transfer means 155 comprises fingers 154, FIG. 1B, fastened to a bracket member 156, FIG. 1C, bolted to a post 158 rotatably supported at its opposite ends to the plates 90 and 92. A spring 160, FIG. 1C, secured at one end to the bracket member 156 and at its other end to the plate 92 biases the fingers 154 into engagement with a bar plate 162. At the upper end of each post 158, there is fixed an arm 166 and this arm has at its distal end a cam follower 168 held by the spring in engagement with the peripheral edge 170 of a cam plate 172 mounted to the upper end of the bearing sleeve 147 and rotatable therewith. The peripheral edge 170 of the cam plate 172, FIG. 3, is configured to cause the fingers 154 to be retracted from the bar plate 162 at the place of transfer of the labels from the picker member 157 to the applicator member, to close the fingers on the labels so as to strip the label from the picker member 157 and again retract the fingers before application of the label to the neck of the bottle to release the label to the neck of the bottle. The labels are removed from a magazine 159 by a picker member 157 and glue is applied to the label by a glue-coated roll 166.

Figure 4A:
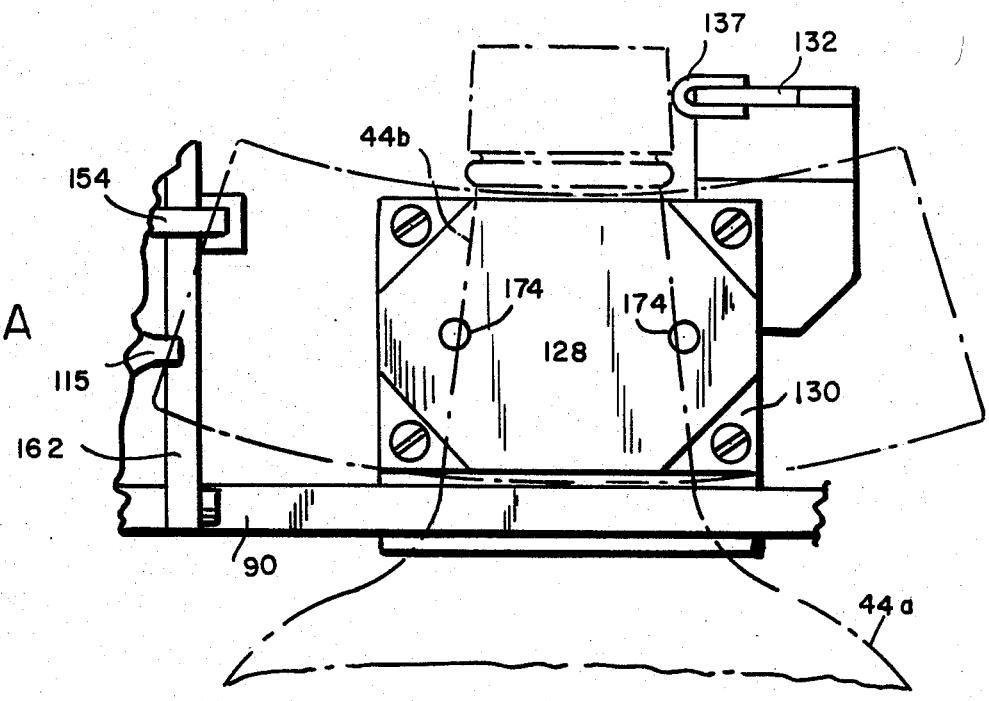
FIG. 4A is a fragmentary elevation showing the neck of a bottle to which a label is being applied by a label applicator.

To assist in conducting the transfer of labels from the picker members 157 to the applicator members 128 and transfer the labels from the applicator members 128 to the bottles B, there is provided vacuum means operative at the point of transfer of the labels from the picker members 157 to the applicator member 128 to suck the labels into engagement with the surface of the applicator member and pressure means operable at the place of transfer of the labels into engagement with the necks of the bottles to blow the labels away from the applicator members 128. This is achieved, as herein illustrated, by providing passages 174—174 through the applicator members 128, FIGS. 4A and 8, open at one end of the surface of the applicator members 128 and connected at their other ends with passages 176 which, in turn, are connected to one end of flexible conductors 178, FIG. 7. The other ends of the conductors 178 are connected by couplings 179 to a manifold 180. The manifold 180 comprises an upper fixed ring 182 containing arcuate slots 184 and 186, FIG. 6, and a lower rotatable ring 188. Rotation of the lower ring 188 relative to the upper ring 182 supplies air pressure to the slot 184 and a vacuum to the slot 186 and to the conductors 178 as the ring 188 is rotated relative to the ring 182 to blow a label free of the applicator member 128 at the place of engagement of the applicator member 128 with the neck of the bottle and to hold the label to the surface of the applicator as it travels from the place of release of the labels to the place of application of the labels. FIG. 3 diagrammatically shows the circular path of travel of the applicators as they are moved toward and away from the bottles and the periods during which the vacuum is applied and the air pressure is applied. Couplings 190 fixed to the cam plate 172 provide for connecting the upper ring to a source of vacuum and a source of air pressure. As has now been described, the applicators for applying body labels and the applicators for applying neck labels are fixed to a common drive at a common station and operate in unison to simultaneously apply labels to the surface areas at different radial distances from the vertical axis of the bottles and at different radial distances from the vertical axis of rotation of the applicators in such a manner as to insure symmetrical arrangement of the labels applied to the areas of different radius of curvature with respect to the vertical axis of the bottles to each other.

It should be understood that the present disclosure is for the purpose of illustration only and includes all modifications or improvements which fall within the scope of the claims.

What is claimed is:

1. Labeling apparatus comprising conveyor means movable along a predetermined path for moving bottles resting thereon at a predetermined spacing along said path, an applicator for applying labels to bottles as they travel along said path, a turret for supporting the applicator for movement in a circular path adjacent the conveyor, means defining a radial slot in the turret, the outer end of which is circumferentially wider than the inner end, means engaged with the slot supporting the applicator for radial movement in the slot and for pivotal movement therein, spring means biasing the applicator in a direction to hold the applicator support means engaged with the leading side of the slot such that when moved radially to the outer end of the slot, the applicator is displaced forwardly of the radial center line of the slot in the direction of rotation and is capable at this position of being displaced rearwardly of the radial center line of the slot with respect to the direction of rotation, cam means for at times effecting radial movement of the applicator to engage the applicator with the bottle and means mounted to the applicator movable thereby into engagement with the trailing side of the bottle before the applicator is moved into engagement with the bottle to move the applicator in the slot relative to the turret in a direction opposite to the direction of rotation of the turret to compensate for any difference in the rate of linear speed of the conveyor and the rate of rotational speed of the applicator.

2. Labeling apparatus according to claim 1 comprising means for supplying glue-coated labels to the applicator.

3. Labeling apparatus according to claim 2 comprising means associated with the applicator and rotatable therewith for stripping the glue-coated labels from the means for supplying the labels.

4. Labeling apparatus according to claim 3 wherein said means for stripping the labels from the means for supplying labels comprises stripper fingers for clamping the labels to the applicator at the place of stripping and for releasing the labels prior to application to the bottles.

5. Labeling apparatus according to claim 2 comprising vacuum means for holding the labels engaged with the applicator while the applicator travels from the place of supply of labels to the place of application of labels to the bottles and air jet means for separating the labels from the applicator at the place of attachment to the bottles.

* * * * *